United States Patent [19]

Thode

[11] Patent Number: 4,474,534

[45] Date of Patent: Oct. 2, 1984

[54] AXIAL FLOW FAN

[75] Inventor: Herbert W. Thode, Oradell, N.J.

[73] Assignee: General Dynamics Corp., Avenel, N.J.

[21] Appl. No.: 378,839

[22] Filed: May 17, 1982

[51] Int. Cl.[3] ..... F04D 29/32; F04D 29/66

[52] U.S. Cl. ..... 416/203; 415/219 R

[58] Field of Search ..... 416/203, 214 R; 415/219

[56] References Cited

U.S. PATENT DOCUMENTS

| | | | |
|---|---|---|---|
| 2,500,071 | 3/1950 | Hans | 415/119 |
| 2,609,058 | 9/1952 | Place . | |
| 2,739,656 | 3/1956 | Raser, Jr. . | |
| 3,006,603 | 10/1961 | Caruso et al. | 416/203 X |
| 3,058,528 | 10/1962 | Hiersch | 446/203 |
| 3,073,096 | 1/1963 | Hayes, Jr. . | |
| 3,147,541 | 9/1964 | Hathaway . | |
| 3,161,239 | 12/1964 | Andersen | 416/214 |
| 3,194,487 | 7/1965 | Tyler et al. | 415/119 X |
| 3,315,749 | 4/1967 | Parsons et al. . | |
| 3,328,867 | 7/1967 | Guengant . | |
| 3,347,520 | 10/1967 | Owczarek | 415/119 |
| 3,356,154 | 12/1967 | Cassidy . | |
| 3,386,155 | 6/1968 | Jenkinson . | |
| 3,398,866 | 8/1968 | La Flame et al. . | |
| 3,698,837 | 10/1972 | Marcellin | 416/214 X |
| 3,764,225 | 10/1973 | Dzung | 415/199.5 X |
| 3,963,373 | 6/1976 | Macauley | 416/214 |
| 4,003,677 | 1/1977 | Parkes | 416/214 R X |
| 4,253,800 | 3/1981 | Segawa | 416/500 X |

FOREIGN PATENT DOCUMENTS

| | | | |
|---|---|---|---|
| 1177277 | 9/1964 | Fed. Rep. of Germany | 416/203 |
| 2524555 | 12/1975 | Fed. Rep. of Germany | 416/203 |
| 1144900 | 10/1957 | France | 416/203 |
| 992941 | 5/1965 | United Kingdom | 415/119 |
| 1523884 | 9/1978 | United Kingdom | 416/203 |
| 2054058 | 1/1981 | United Kingdom | 416/203 |

OTHER PUBLICATIONS

Article entitled "Low Pressure Ratio Fan Noise Experiment and Theory" by F. B. Metzger & D. B. Hanson *ASME Publication* 72-GT-40, pp. 19-25.

Article entitled "The Mechanisms of Noise Generation in a Compressor Model" by B. T. Hulse & J. B. Large, *ASME Publication* 66-GT/N-42, pp. 1-7.

Article entitled "Sound Generation in Subsonic Turbomachinery" by C. L. Morfey, *ASME Publication* 69--WA/FE-4, pp. 1-9.

Article entitled "Fan Compressor Noise Reduction" by M. J. Benzakein & S. B. Kazin, *ASME Publication* 69-GT-9, pp. 1-9.

Article entitled "Analytical Prediction of Fan/Compressor Noise" by M. J. Benzakein & W. R. Morgan, *ASME Publication* 69-WA/GT-10, pp. 1-8.

Article entitled "Discrete Frequency Noise Generation from an Axial Flow Fan Blade Row" by Ramani Mani, *ASME Publication* 69-FE-12, pp. 1-7.

Article entitled "Controlling The Tonal Characteristics of the Aerodynamic Noise Generated by Fan Rotors" by R. C. Mellin & G. Sovran, *ASME Publication* 69--WA/FE-23, pp. 1-12.

Article entitled "Procedure for Optimum Design in Relation to Noise for Low-Speed Ducted Fans" by C. G. van Niekerk, *ASME Publication,* 69-WA/GT-4, pp. 1-7.

Article entitled "Lifting Fan Noise Studies" by G. Krishnappa & G. G. Levy, *ASME Publication,* 69--WA/GT-6, pp. 1-9.

*Primary Examiner*—Everette A. Powell, Jr.

*Attorney, Agent, or Firm*—Brumbaugh, Graves, Donohue & Raymond

[57] ABSTRACT

An axial flow fan has a plurality of impeller blades spaced around a hub assembly. The leading edge of each blade overlaps completely the trailing edge of the preceding blade, and the angular spacing between the radial center lines of the blades is unequal, preferably varying in a sinusoidal pattern, so that tonal noise of the fan is effectively attenuated.

8 Claims, 5 Drawing Figures

AXIAL FLOW FAN

BACKGROUND OF THE INVENTION

The present invention is directed to an improvement in axial flow fans of the type having a plurality of rotating impeller blades and used for circulating a relatively large volume of air, for example for blowing air through an air circulation duct.

The abatement of noise in axial flow fans has been a longstanding problem. There are two types of noise produced by the flow of air (as opposed to fan motor noise or other possible mechanical sources of noise) through an axial flow fan: vortex or turbulence noise and rotational noise. Turbulence noise is generally produced as broad band, background noise, and except at unusually high sound levels is not particularly annoying. In contrast, rotational noise, which is produced by the rotating pressure fields of the individual blades of the rotor, tends to produce audible noise at discrete frequencies. Such noise is tonal in character, and can be annoying even when its sound level is not excessively high. The presence of noise which is concentrated at discrete, audible frequencies, i.e. tonal noise, raises the perceived level of fan noise as compared with a fan having the same overall level of noise spread out evenly over the frequency spectrum.

From past studies, it is known that tonal fan noise is produced at frequencies dependent on the number of blades and the speed of rotor rotation, and results from discontinuities, or pressure pulses, produced by the moving blades. Tonal fan noise is generated with particular intensity at the blade pass frequency, a fundamental frequency characteristic of the impeller construction and of blade rpm. Total noise is also produced at harmonics (multiples) of the fundamental blade pass frequency.

An attempt to attenuate tonal or "perceived" noise is described in detail in an article entitled "Controlling The Tonal Characteristics Of The Aerodynamic Noise Generated By Fan Rotors", R. C. Mellin and G. Sovren, ASME Journal of Basic Engineering, 69-WA/FE-23. In the Mellin et al method, the rotor blades are spaced unequally in a pattern selected to reduce the noise level peaks occurring at the fundamental blade pass frequency and at several of the prevailing harmonics, as compared with equally spaced rotor blades. Preferably, the selected blade spacing pattern is such that no two adjacent blades overlap, i.e. that there is at least a minimum gap between even the two most closely spaced blades, in order that the fan may be fabricated using a conventinal axial-draw type of casting. A similar approach, in which the blades are spaced unequally and also the blade angle is varied, is disclosed in U.S. Pat. No. 4,253,800 to Segawa et al.

Another approach for effecting noise abatement in axial flow fans is to use a sound trap positioned at the discharge side of the fan. In one such design, a sintered metal filter is attached concentrically to the fan for absorbing a portion of the fan noise. While such a filter can ideally suppress tonal noise, in use the sintered metal screen is vulnerable to clogging, which may produce irritating, high level discrete frequency tones. Such a filter may also reduce the pumping efficiency of the fan.

SUMMARY OF THE INVENTION

The present invention is an axial flow fan in which identifiable blade pass frequencies and harmonic noise signature is effectively attenuated, so as to minimize the production of tonal noise.

More particularly, an axial flow fan in accordance with the invention has an impeller construction in which each blade is overlapped by its adjacent blades, such that there is no gap through the blades when viewed in the axial direction. The blades are unequally spaced within predefined limits to retain complete overlap. Preferably, the relative spacing between adjacent blades follows a sinusoidal pattern.

In contrast with known blade constructions, an axial flow fan having a plurality of completely overlapped blades produces a rotational noise pattern in which tonal noise peaks at harmonics of the basic blade pass frequency are almost completely eliminated. In addition to blade overlap to eliminate harmonics, the blades are spaced unequally in order to modulate the noise peak at the basic blade pass frequency, i.e. to spread the fundamental frequency into side bands, and with the resultant fan construction tonal noise is attenuated and the perceived noise level is effectively reduced. In tests conducted with fans in accordance with the present invention, a rushing noise, or what is referred to as "white" noise, is produced, which is highly desirable in fan construction.

A blade configuration in accordance with the invention does not adversely affect pumping efficiency of the fan. For any particular size and pumping requirements, an axial flow fan constructed in accordance with the invention operates at a lower perceived noise level than a comparable axial flow fan having equally spaced, non-overlapping blades. As a result, such a fan can operate within tolerable perceived noise limits without the need for sound traps or other noise abatement accessories, in instances where a conventional fan would not.

A fan in accordance with the invention is especially advantageous for use in environments in which generated noise is easily transmitted, for example where used in submarines. When used in air circulation systems for submarines, a fan in accordance with the invention will act to reduce overside submarine noise signature.

In spacing the blades, the range of variations of blade spacing is kept within predefined limits such that both the leading and trailing edges of the blades, at maximum blade spacing, remain completely overlapped from the hub out to the blade tips. Preferably, the fundamental blade passing frequency is modulated at a multiple of the rotational frequency, and as noted above is modulated by a sinusoidol pattern of blade spacing. The spacing pattern may follow either one cycle or multiple cycles per rotation of the rotor hub, as desired.

In an exemplary embodiment, a hub assembly includes a central hub, an outer spinner mounted on the hub and having a cylindrical outer rim portion for supporting rotor blades. A support spinner is also mounted on the hub and engages the unsupported edge of the outer spinner rim portion for support thereof. The outer spinner cylindrical rim portion is provided with plurality of slots, each for receiving a rotor blade. The radial centerlines of the slots and associated rotor blades are sinusoidally spaced around the perimeter of the rim for effecting the desired sinusoidal spacing between the rotor blades. By way of illustration, for a 23 blade impeller the spacing between adjacent blades varies from a minimum of 13° 39.0′ to a maximum of 17° 37.8′ and the cyclic pattern occurs twice in the 360° around the hub.

DETAILED DESCRIPTION OF A PREFERRED EMBODIMENT

Figure 1:
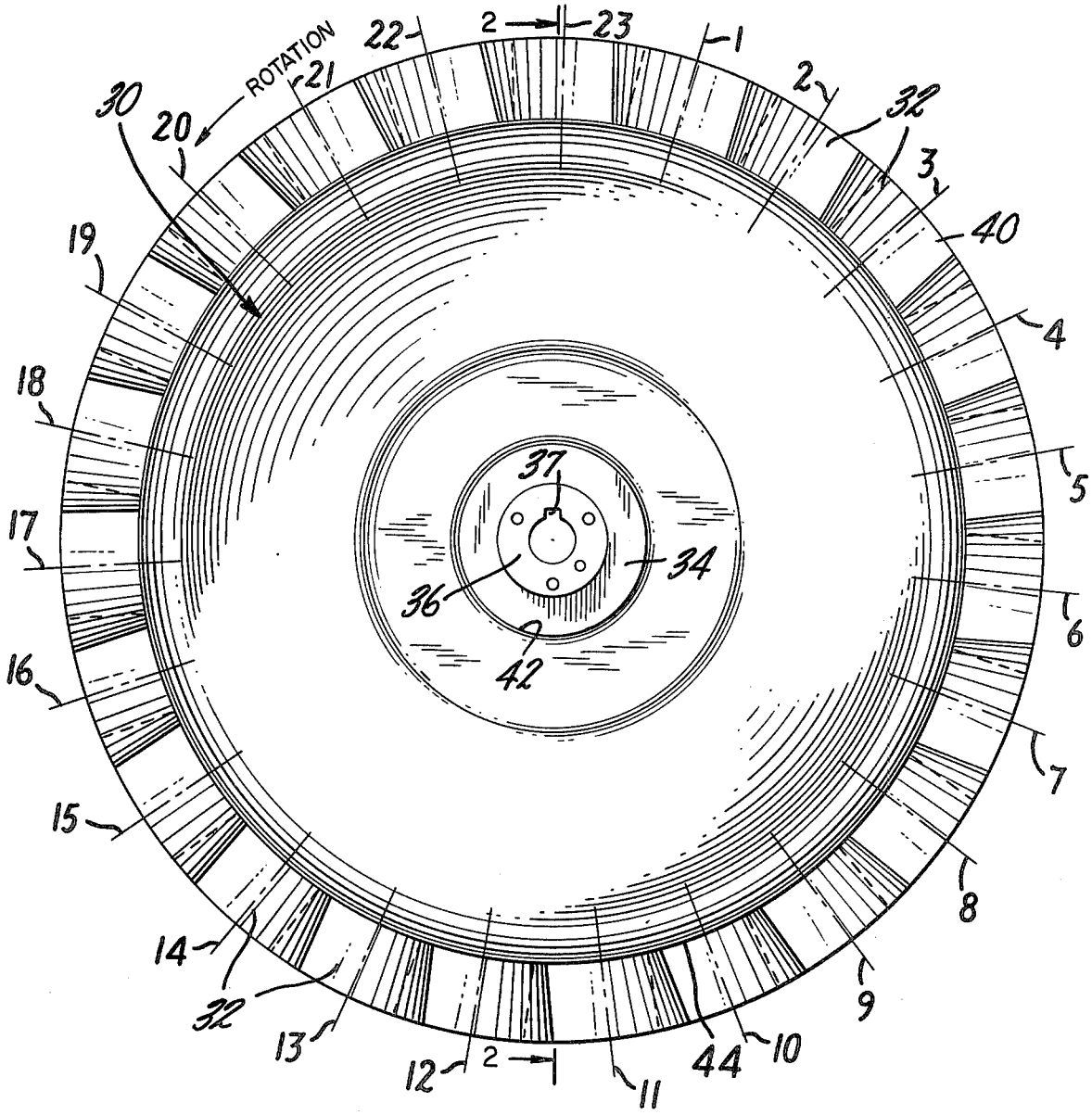
FIG. 1 is a front view of an axial flow fan in accordance with the invention.

The impeller or axial flow fan according to the present invention includes a hub assembly 30 as well as a plurality of circumferentially spaced impeller or rotor blades 32.

The hub assembly 30 is constructed with a hub 34 having a central bore therethrough, which receives a bushing 36. A plurality of screws 38 mount the bushing 36 to the hub 34. The bushing 36 has a keyway 37 to facilitate mounting the hub assembly to a motor drive. The hub 34 is formed with a cylindrical outer surface and an annular boss 35, which defines a pair of axially opposed annular shoulders.

Figure 5:
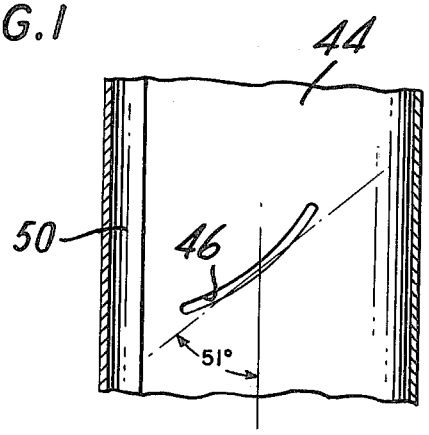
FIG. 5 is a view taken through lines 5—5 of FIG. 1.
Figure 2:
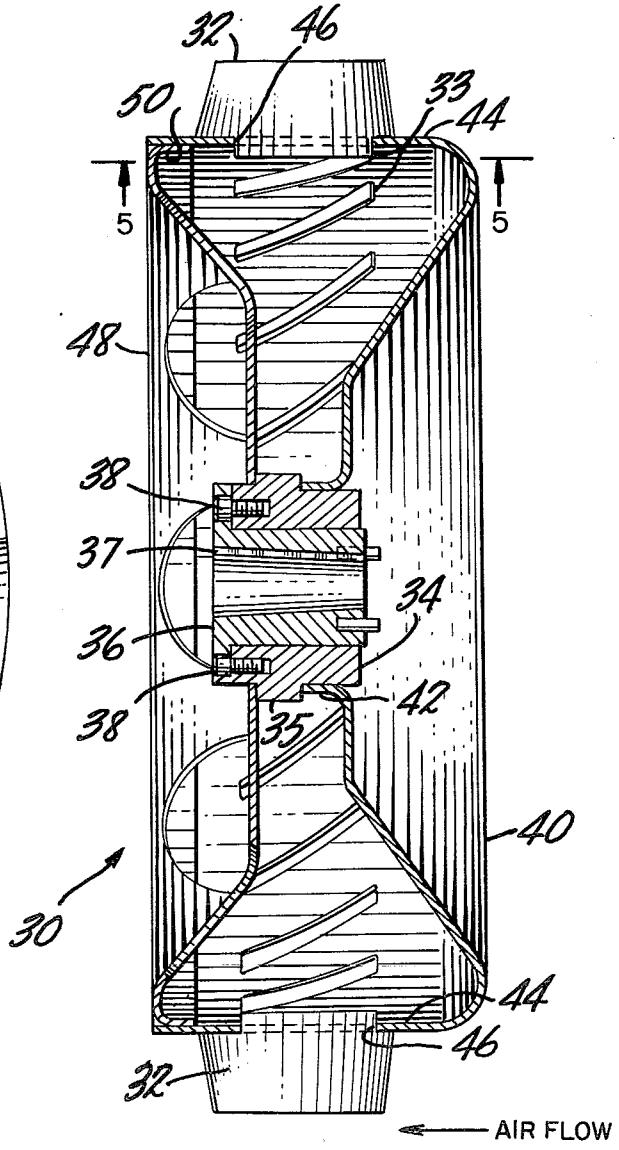
FIG. 2 is a side sectional view of the fan shown in FIG. 1 taken through lines 2—2 thereof.

A forward facing, outer spinner 40 is mounted on the hub 34. An axially extending tubular portion 42 of the outer spinner 40 slides on the hub 34 and engages one shoulder of the hub boss 35. The outer spinner has a cylindrical outer rim portion 44, containing a plurality of slots 46 for receiving impeller blades 32. A typical slot, which is shown in FIG. 5, is arranged at an angle of 51° relative to the transverse direction.

A support spinner 42 engages the unsupported, rear edge of the rim portion 44. A central opening in the support spinner fits on the hub 34, and abuts against the other shoulder of the boss 35. The end of the support spinner 42 is bent inwardly to form an annular ring portion 50 which is disposed within the rim portion 44 for supporting the same. As shown, the outer spinner 40, which is on the inlet side of the fan, projects forward in the axial direction in the vicinity of the blades 32. The use of a spinner arrangement as shown reduces inlet turbulence and noise.

Figure 4:
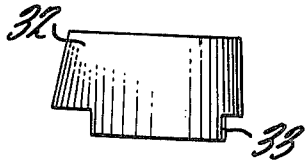
FIG. 4 is a plan view of an impeller blade used in the axial flow fan of FIGS. 1–3.

As shown in FIG. 4, a typical blade 32 has a mounting tab portion 33 along its lower edge. The tab portions 33 fit snugly in the slots 46 in the outer spinner rim 42. The shape of the blades is selected in accordance with known principles of blade design, depending upon the particular air performance characteristics desired. In the illustrative embodiment, the blades are given a variable camber and twist. The blade 32 may also be slightly tapered along its leading and trailing edges as shown, which has been found to reduce horsepower requirements.

Figure 3:
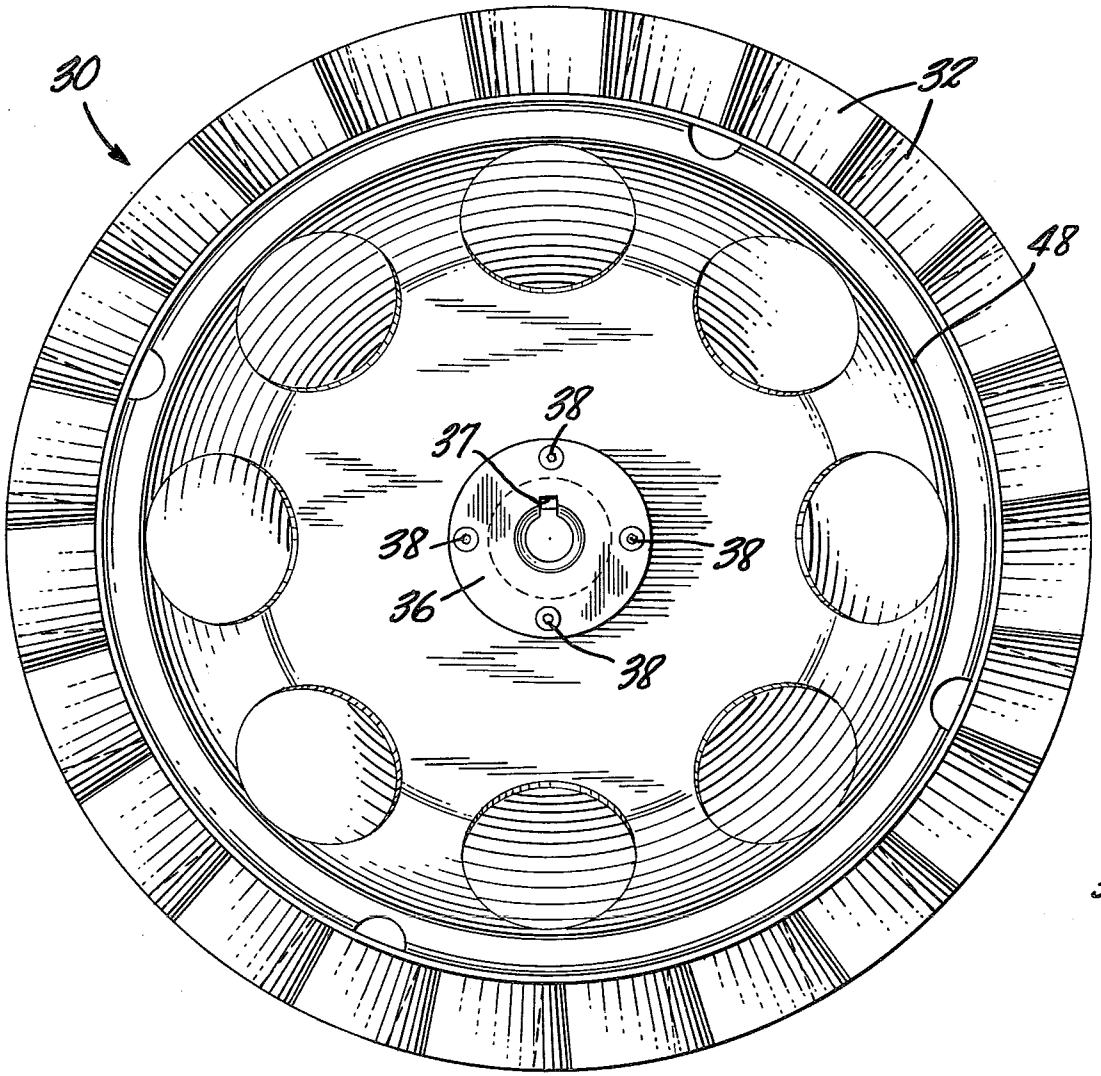
FIG. 3 is a rear view of the fan shown in FIG. 1.

The radial center line of each of the 23 blades is shown in FIG. 1. As illustrated in FIGS. 1 and 3, the blades are completely overlapped by adjacent blades, such that viewed axially there are no see-through spaces between adjacent blades. The overlap extends from the hub assembly 30 radially outwardly to the blade tips. As used herein, the term "completely overlapped" refers to such a blade configuration, i.e. where viewed in the axial direction there is no gap between the trailing edge of one blade and the leading edge of the next adjacent blade.

In the illustrated example, as 23 blade configuration has been selected. In practice any number of blades may be used, as long as the blades are completely overlapped and unequally spaced. In one embodiment tested, the hub assembly had a diameter of 16 inches, and the blades sized to produce a 19″ nominal tip diameter (1½″ blade height). In another test configuration, 2″ high blades were used to produce a 20″ nominal tip diameter of the impeller.

As discussed above, the production of rotational noise at the basic blade pass frequency, as well as at harmonics thereof, is the result of pressure pulses produced by the rotating impeller blades. It is expected that a fan having no impeller blades produces no periodic pulses, and therefore produces no tonal noise at either the basic blade pass frequency or its harmonics. As more blades are added, more pulses are produced and tonal noise increases. The noise level produced at both the fundamental frequency and at the harmonics increases.

In accordance with the invention, it has been found that, as to the harmonics of the blade pass frequency, while the magnitudes of the noise peaks increase, as expected, as the width of the blades increases from zero (which corresponds to having no blades), the harmonics reach a maximum at a point where the ratio of the spacing between blades to blade width (see-through ratio) reaches one. Thereafter, the magnitude of the noise peaks at the harmonics begins to decrease again as the see-through ratio approaches zero (corresponding to completely overlapped blades).

In accordance with the invention, therefore, it has been found that by completely overlapping the blades (i.e. a see-through ratio of zero), the production of harmonics associated with the basic blade pass frequency can be substantially eliminated. The level of random noise increases slightly, but the remaining tonal noise is produced essentially only at the fundamental frequency.

In accordance with the invention, the noise peak produced at the basic blade pass frequency is attenuated by modulating the basic blade pass frequency, by varying the spacing between adjacent impeller blades. The effect of unequal blade spacing is to spread out the fundamental frequency into side bands, thereby reducing the noise peak at the fundamental frequency.

In a preferred embodiment, the basic blade pass frequency is sinusoidally modulated at a modulating frequency which is a multiple of rotational speed. In determining the blade spacing for the various blades around the periphery of the rotor, the optimum blade spacing is selected to limit the range of maximum spacing between the blades to ensure blade overlap for all the blades.

As shown in FIGS. 1 and 3, a prime number of blades, 23 in the example, have been positioned circumferentially around the hub. The particular number, i.e. 23, has been chosen arbitrarily, but for the illustrative size and relative dimensions of the blade and hub, a choice of approximately 23 blades will assure that blade overlap can be retained, without having to resort to unusually long (i.e. chord length, as opposed to height) blades. The blades are positioned unequally about the hub in a manner such that the spacing varies sinusoidally. In other words, in traversing the periphery of the rotor rim between the first and last blades, the angular spacing between adjacent blades follows a sine curve.

To effect sinusoidal frequency modulation, the Bessel equation may be used to determine an optimum blade spacing. The argument of bessel functions of the first kind ($\Delta\phi$) is defined as:

$$\Delta\phi = \frac{\Delta f}{f_m}$$

In the foregoing equation, $\Delta f$ is a difference between the instantaneous frequency of the blades with the narrowest relative spacing (the highest frequency) and the blades with the largest relative blade spacing (the lowest rotational frequency). The term $f_m$ is the selected modulating frequency. By determining an optimum range for $\Delta\phi$, the equation may thereafter be solved to determine an optimum combination of blade spacing pattern and modulating frequency.

The argument $\Delta\phi$ represents the abscissa of the Bessel function graph. The magnitudes of the Bessel function curves are then representative of the magnitude of the basic blade pass frequency relative to its various side bands. For three representative points on the abscissa ($\Delta\phi=1$, 2 and 3), the relative magnitudes of the blade pass frequency (BPF) and sidebands are as follows:

| | Frequency (Hz) | $\Delta\phi$(argument) = | AMPLITUDE 1 | 2 | 3 |
|---|---|---|---|---|---|
| (Lower side | 1140 | | .00 | .02 | .13 |
| Bands) | 1200 | | .02 | .13 | .30 |
| | 1260 | | .12 | .35 | .48 |
| | 1320 | | .458 | .57 | .32 |
| BPF | 1380 | | .77 | .323 | .26 |
| | 1440 | | .45 | .57 | .32 |
| (Upper side | 1500 | | .12 | .35 | .48 |
| Bands) | 1560 | | .02 | .13 | .30 |
| | 1620 | | .00 | .02 | .13 |

From the Bessel graph, it can be determined that in the range of $\Delta\phi=1.3$–$1.5$, the fundamental BPF and the sidebands are of about equal magnitudes. A fan configuration in which $\Delta\phi$ falls within such a range therefore effectively modulates the basic blade pass frequency, since the blade pass frequency will be spread evenly into the sidebands.

$\Delta f$, the range of variation in blade spacing, may be determined mathematically or may be chosen by sampling. By way of example, for a 23 blade unit operating at 1800 rpm (30 rps) the basic blade pass frequency is:

$$BPF = 30 \text{ rev/sec} \times 23 \text{ blades/rev} = 690 \text{ hz.}$$

As a first approximation, the variation in blade spacing is chosen to range from 14.4°, which is the equivalent of 25 blades, for the two closest blades (i.e. if all the blades were equally spaced at 14.4°, there would be 25 blades on the rotor), to 17.2°, which is equivalent to 21 blades (two furthest spaced blades). For such an arrangement, the difference in instantaneous frequency between the two closest and the two furthest spaced blades, $\Delta f$, is as follows:

$$\Delta f = (30 \text{ rps} \times 25 \text{ blades}) - (30 \text{ rps} \times 21 \text{ blades})$$

$$= 120 \text{ hz}$$

If BPF is modulated twice per revolution, then $$\Delta\phi = \frac{\Delta f}{f_m} = \frac{120 \text{ hz}}{2 \frac{\text{mod.}}{\text{rev}} \times 30 \text{ rps}} = 2$$

Since $\Delta\phi$ is not within the optimum modulation range of 1.3–1.5, the blade pattern is preferably modified so that there is less of a difference between maximum and minimum blade spacing. For example, as a second approximation the 23 blades can be given a variation of $\pm 1.5$ blades, rather than the initial estimate of $\pm 2$ blades (21.5 blade equivalent minimum frequency to 24.5 blade equivalent maximum frequency). Such a pattern yields a $\Delta\phi=1.5$ (approximate), and accordingly will effectively modulate tonal noise.

The maximum and minimum blade spacings represent the spacing at the top and bottom, respectively, of the sine curve. The spacing of the intermediate blades can thereafter be ascertained from the curve or by calculation. Once the blade spacing pattern is determined, the chord length of the blades is selected to assure that all of the blades overlap.

In a preferred embodiment shown in FIGS. 1 and 3, a 23 blade configuration, all overlapped, is shown. The number of modulations may be selected as desired, but for a 23 blade impeller two modulations per revolution ($k=2$) is preferable, since for $k=1$ the rotor is unbalanced, and for k greater than two the modulation pattern varies too sharply for the number of blades. $\Delta\phi$ is greater than or equal to 1.3, and the chord length assures at least a 10 percent overlap at the maximum blade spacing. The impeller may be fabricated by dip brazing, with blades having a variable camber and twist. While the modulating frequency and number of blades can be varied, the design should result in a $\Delta\phi$ of at least 1.3 to attenuate blade pass frequency.

For a configuration of 23 blades, with a modulation of two times per revolution, and which operates at 3600 rpm, the following pattern of blade spacing (measured from the blade radial center line) results:

| BLADE NUMBER | BLADE SPACING DEGREES ADVANCED | ACCUMULATIVE POSITION (DEGREES) |
|---|---|---|
| 1 | 13° 43.8′ | 13° 43.8′ |
| 2 | 14° 17.4′ | 28° 0.6′ |
| 3 | 15° 15.0′ | 43° 15.6′ |
| 4 | 16° 19.2′ | 59° 34.8′ |
| 5 | 17° 12.0′ | 76° 46.8′ |
| 6 | 17° 37.8′ | 94° 25.2′ |
| 7 | 17° 29.4′ | 111° 54.0′ |
| 8 | 16° 48.6′ | 128° 46.2′ |
| 9 | 15° 47.4′ | 144° 30.0′ |
| 10 | 14° 43.8′ | 159° 13.8′ |
| 11 | 13° 56.4′ | 173° 10.2′ |
| 12 | 13° 39.0′ | 186° 49.8′ |
| 13 | 13° 56.4′ | 200° 46.2′ |
| 14 | 14° 43.8′ | 215° 30.0′ |
| 15 | 15° 47.4′ | 231° 17.4′ |
| 16 | 16° 48.6′ | 248° 6.0′ |
| 17 | 17° 29.4′ | 265° 34.8′ |
| 18 | 17° 37.8′ | 283° 13.2′ |
| 19 | 17° 12.0′ | 300° 25.2′ |
| 20 | 16° 19.2′ | 316° 44.4′ |
| 21 | 15° 15.0′ | 331° 59.4′ |
| 22 | 14° 17.4′ | 346° 16.2′ |
| 23 | 13° 43.8′ | 360° 0.0′ |

The foregoing method of sinusoidal modulation represents only one approach to modulating the basic blade pass frequency in the fan of the present invention. In place of sinusoidal modulation, the spacing between blades may be selected on the basis of a mirror image sinusoidal pattern. In such a construction, the blades on each side of the center line are retained at the same spacing, with a constant increment of increased angular spacing between successive blades on each half of the rotor.

Interaction can also occur between the pressure fields of the rotating blades and those of stationary vanes which are commonly used in axial flow fans. Such interaction can cause a distortion in the fundamental frequency otherwise produced, as well as the associated harmonics, but in general a similar type of tonal noise, originating from the discontinuities or pressure pulses produced by the rotating fan blades, results. The present invention may effectively be employed to attenuate tonal noise in such vaneaxial fans.

In use, the blades of axial flow fans are normally disposed within a housing. Preferably the tip clearance, i.e. the clearance between the impeller blade and the housing, is controlled at a predefined minimum. It has been found that blade noise decreases with decreasing tip clearance up to a limit, e.g. 0.025 inches, whereafter further reduction and tip clearance does not produce substantial noise reduction.

The blades in the preferred embodiment shown are provided with a blade twist and variable camber. Blade twist affects the air performance and efficiency of a fan. While a particular configuration has been shown, in practice the particular geometry of the blade is selected in accordance with the air performance requirements of the fan.

The foregoing represents a description of a preferred embodiment of axial flow fan in accordance with the invention. Variations and modifications of the invention will be apparent to persons skilled in the art without departing from the inventive concepts disclosed herein. By way of example, while a fan having a particular number of blades has been shown and described, the number of fan blades may be varied so long as complete blade overlap and unequal spacing is effected. All such modifications and variations are intended to be within the scope of the invention as defined in the following claims.

I claim:

1. An axial flow fan comprising:

a hub assembly rotatable about an axis;

a plurality of impeller blades mounted on said hub assembly and spaced circumferentially about said axis, wherein said blades are completely overlapped, viewed in the axial direction, with adjacent blades of said fan, and wherein said blades are sinusoidally spaced about said axis.

2. An axial flow fan as defined in claim 1, wherein each blade has a radial center line, and wherein said center lines are sinusoidally spaced around the periphery of said hub assembly for effecting sinusoidal modulation of the basic blade pass frequency of said fan.

3. An axial flow fan as defined in claim 2, wherein the blade center lines are sinusoidally spaced through at least two cycles.

4. An axial flow fan as defined in claim 1 or 2, wherein said hub assembly comprises a hub and an outer spinner, mounted on said hub, having an annular rim thereon radially outward of said hub for supporting said impeller blades.

5. An axial flow fan as defined in claim 4, wherein said rim has a plurality of slots therein, one slot for supporting each blade, and wherein each blade has a projecting portion sized to be received in a slot of said rim.

6. An axial flow fan as defined in claim 5, comprising a support spinner mounted on said hub, at a position axially spaced from said outer spinner, wherein said support spinner has a portion engaging said rim for supporting said rim.

7. An axial flow fan as defined in claim 5, wherein said outer spinner is disposed on the inlet side of the fan and has an annular portion projecting forward for reducing inlet turbulence.

8. An axial flow fan as defined in claim 4, wherein each blade has a leading and trailing edge, and said edges are tapered.

* * * * *